United States Patent [19]

Richmond et al.

[11] Patent Number: 4,465,488

[45] Date of Patent: Aug. 14, 1984

[54] COLLAPSIBLE MULTI-CHAMBER MEDICAL FLUID CONTAINER

[75] Inventors: Frank M. Richmond, Harvard; Kenneth W. Larson, Libertyville; Robert A. Miller, Schaumburg, all of Ill.

[73] Assignee: Baxter Travenol Laboratories, Inc., Deerfield, Ill.

[21] Appl. No.: 246,479

[22] Filed: Mar. 23, 1981

[51] Int. Cl.[3] ..... A61J 1/00

[52] U.S. Cl. ..... 604/414

[58] Field of Search ..... 128/214 D, 272.2; 206/219 R; 604/408–416

[56] References Cited

U.S. PATENT DOCUMENTS

| | | | |
|---|---|---|---|
| 2,037,175 | 4/1936 | Northcross | 150/1 |
| 2,157,169 | 5/1939 | Foster | 126/204 |
| 2,176,923 | 10/1939 | Nitardy | 221/60 |
| 2,714,974 | 8/1955 | Sawyer | 222/94 |
| 2,750,075 | 6/1956 | Land et al. | 222/94 |
| 3,006,341 | 10/1961 | Poitras | 128/214 |
| 3,064,802 | 11/1962 | Jess et al. | 206/47 |
| 3,110,308 | 11/1963 | Bellamy | 128/214 D |
| 3,157,312 | 11/1964 | Kitterman | 222/1 |
| 3,224,571 | 12/1965 | Jess et al. | 206/47 |
| 3,482,572 | 12/1969 | Grosclaude et al. | 128/214 |
| 3,520,471 | 7/1970 | Faust | 229/56 |
| 3,685,795 | 8/1972 | Caster | 128/214 D |
| 3,747,813 | 7/1973 | Downey | 222/541 |
| 3,911,918 | 10/1975 | Turner | 128/214 D |
| 3,985,135 | 10/1976 | Carpenter et al. | 128/214 D |
| 4,140,162 | 2/1979 | Gajewski et al. | 150/1 |
| 4,191,231 | 3/1980 | Winchell et al. | 150/8 |
| 4,195,632 | 4/1980 | Parker et al. | 128/214 D |
| 4,198,972 | 4/1980 | Herb | 128/214 D |
| 4,235,233 | 11/1980 | Mouwen | 128/214 |
| 4,294,247 | 10/1981 | Carter et al. | 128/214 D |

OTHER PUBLICATIONS

Copy of Nutriflex® Container sold by Vifor S.A., Geneva, Switzerland.

*Primary Examiner*—Benjamin R. Padgett
*Assistant Examiner*—T. J. Wallen
*Attorney, Agent, or Firm*—Paul C. Flattery; Brad Price; John Caruso

[57] ABSTRACT

A collapsible medical agent container (10) is disclosed having walls (34, 36, 38) defining a plurality of chambers (12, 14) for containing selected quantities of one or more medical fluids or a dry or encapsulated drug or other reagent in separate sealed condition. Opening means which communicates between adjacent chambers (12, 14) for passage of fluid from one chamber to another, is normally closed by frangible closure (18) which maintains the chambers (12, 14) in separate hermetically sealed condition until flow between the chambers (12, 14) is needed. The frangible closure (18) has an elongated relatively rigid portion (20) which extends into one of the chambers and is disposed within a protective retentive tube (24), and a relatively weakened portion (22) adjacent the opening means. The closure (18) is manually openable from exterior the container (10) to permit flow between the chambers (12, 14), such as for mixing, by grasping the elongated portion (20) through the walls (30, 32) of the container (10) and bending it until the relatively weakened portion (22) is fractured.

6 Claims, 12 Drawing Figures

FIG 4
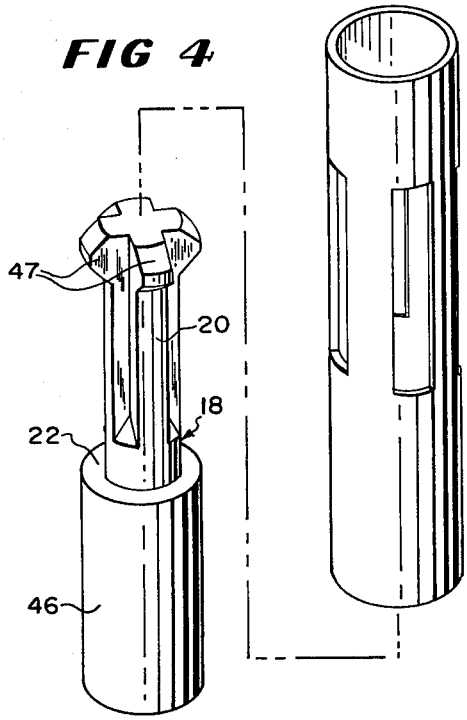
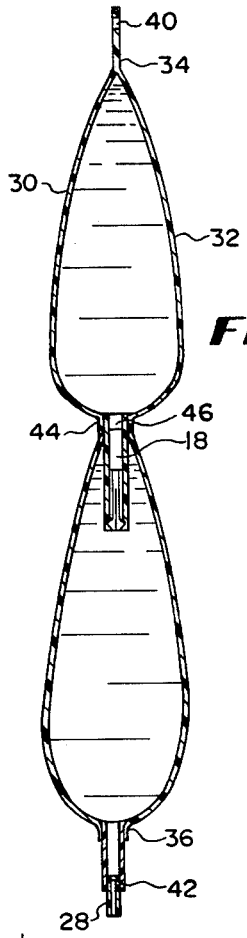
FIG. 5
FIG. 6
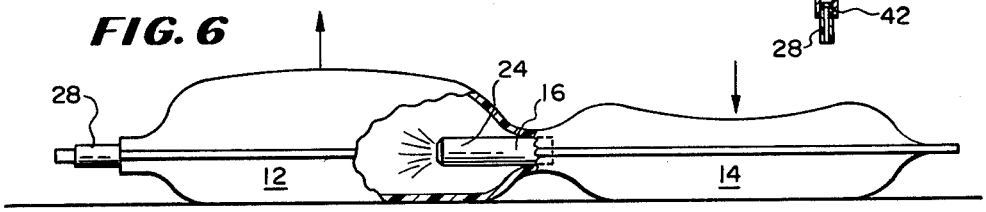
FIG. 7
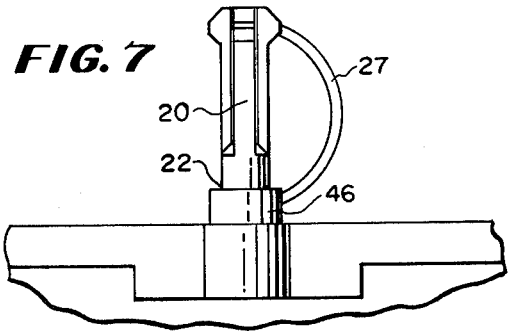
FIG. 8
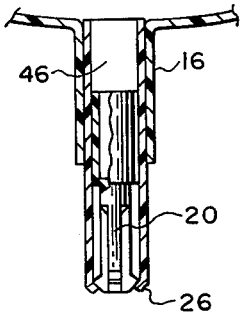

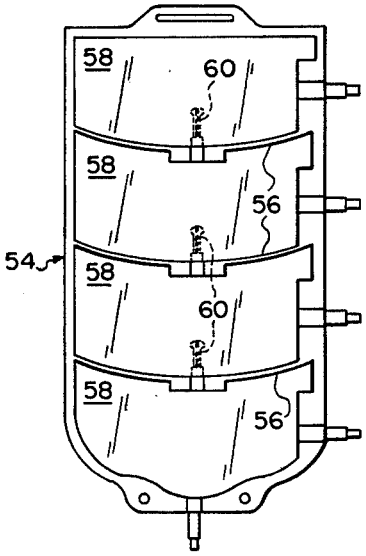
FIG. 9
FIG. 10
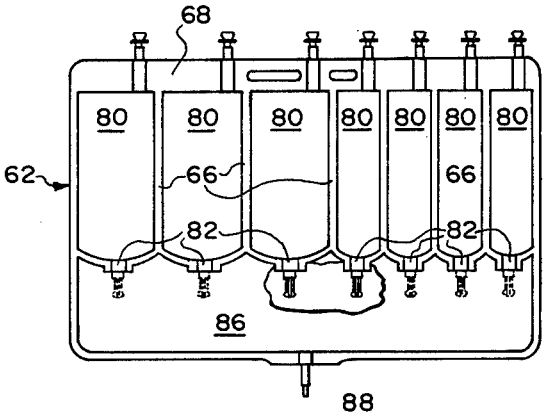
FIG. 11
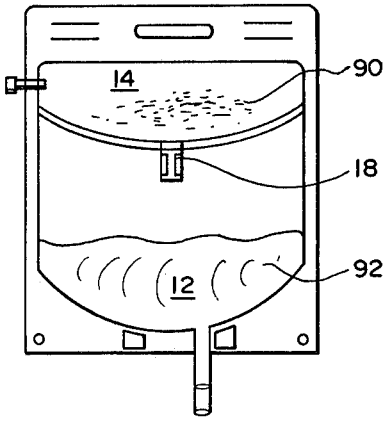
FIG. 12
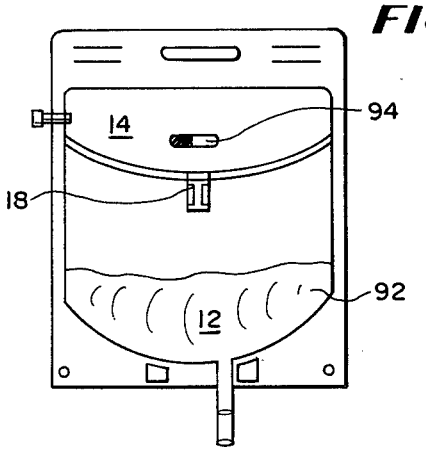

COLLAPSIBLE MULTI-CHAMBER MEDICAL FLUID CONTAINER

BACKGROUND OF THE INVENTION

The present invention relates, in general, to collapsible medical fluid containers and, in particular, to such containers with two or more sealed compartments or chambers in which separate quantities of medical fluids or dry drugs or reagents may be stored for later intermixing and/or dispensing.

There are a number of medical fluids that are made by combining ingredients which, over the passage of time, react or are otherwise incompatible, resulting in unacceptable product degradation, or reduced efficacy. With such fluids, it is desirable to delay final preparation, such as mixing of the ingredients or components, until shortly prior to administration to the patient.

One example is a nutritional parenteral solution made by combining amino acid and dextrose. If there is a delay of many weeks or months between mixture of the ingredients and administration to the patient, a reaction between the ingredients results in unacceptable discoloration of fluid. Another example is the combination of heparin and dextrose. Dextrose has a relatively low pH compared to heparin. With the passage of time after mixing, the more acidic dextrose reduces the effectiveness of the heparin.

The reduced shelf life of these types of medical fluids, due to the reaction or incompatibility, has made large scale production impractical, and it has been the practice for hospital or clinical pharmacies to purchase separate containers of the particular components or ingredients and prepare the finished solution as required. This, of course, requires a relatively time consuming and inefficient transfer of fluid between the containers or into a third container. More importantly, however, the removal of one of the components from its original container carries with it the risk of impairing the sterility of the product.

In another example, it is also useful for dry or encapsulated drugs needing to be reconstituted or diluted prior to administration. The present invention allows the dry drug to be placed in one compartment and a diluent, such as sterile water, or liquid reagent in the other. The two may then be mixed or reconstituted by the means detailed in the application. This provides a sterile self-enclosed environment in which the mixing may take place and provides a more convenient means for maintaining and handling the drug and its appropriate fluid diluent or reagent prior to mixing. By providing controlled drug dosages and specific fluid amounts, it also prevents incorrect mixing or excessive dilution by an administrator.

One container which has been used for packaging of medical fluids in separate compartments is manufactured by Vifor, S.A., a Swiss corporation. It employs a pair of peripherally sealed plastic sheets with an intermediate seal line between the sheets dividing the container into a pair of compartments. An access port between the compartments is normally sealed with a break-apart closure that can be opened from the exterior of the container to permit mixing of the contents without breaking the sterility of the container. The port is opened by gripping an elongated portion of the closure through the plastic sheets and bending it until it breaks. There was a risk, however, with this procedure that the elongated portion may puncture the wall of the container causing leakage as well as a breach of sterility.

In addition to the needs of the medical industry with respect to the types of products and containers discussed above, there is often occasion for the physician to prescribe the periodic administration of a drug or other medical fluid. Such treatment typically requires the nurse or doctor repeatedly to obtain the unit dosage of the particular drug or fluid from the pharmacy and to administer it via syringe either directly into the patient or through an access site in an existing parenteral administration set which is already attached to the patient. In either case, these steps entail additional procedures and routines in the already busy day of most nurses and physicians.

Accordingly, it is a general object of the present invention to provide a medical fluid container for containing two or more medical fluids, or a dry drug or reagent and a diluent or liquid reagent in separate sealed relationship and providing for convenient and sterile intermixing just prior to administration and/or for periodic administration of unit dose quantities.

It is a further object of the present invention to provide such a container which may be opened without risk of puncturing the container wall.

It is another object of the present invention to provide an alternative construction for a multi-compartment container for containing two or more medical fluids or dry drugs and liquid agents in separate sealed relationships.

These and other objects of the present invention are set forth in the following description of the attached drawings which depict the preferred and alternative embodiments of the present invention and of which:

BRIEF DESCRIPTION OF THE DRAWINGS

FIG. 4 is an exploded perspective view of the frangible closure of FIG. 2 and its retention tubing.

FIG. 5 is a vertical cross-sectional view of the container of FIG. 1 taken along line 5—5.

FIG. 6 is a side-elevational, partially removed, of the container of FIG. 1 in a position resting on a flat surface and illustrating the mixing of the contents of the adjacent chambers of the container.

FIG. 7 is a front elevational view of the frangible closure for sealing between adjacent chambers of the container illustrating an alternative retention means.

FIG. 8 is a vertical cross-sectional view of another alternative embodiment of the retention means of the frangible closure.

FIG. 9 is a front elevational view of another container embodying the present invention.

FIG. 10 is a vertical elevational view of yet another alternative container embodying the present invention.

FIG. 11 is a front elevational view of the container of FIG. 1 having a dry drug or reagent in the upper chamber.

FIG. 12 is a front elevational view of the container of FIG. 1 having an encapsulated drug or reagent in the upper chamber.

SUMMARY OF THE INVENTION

Figure 1:
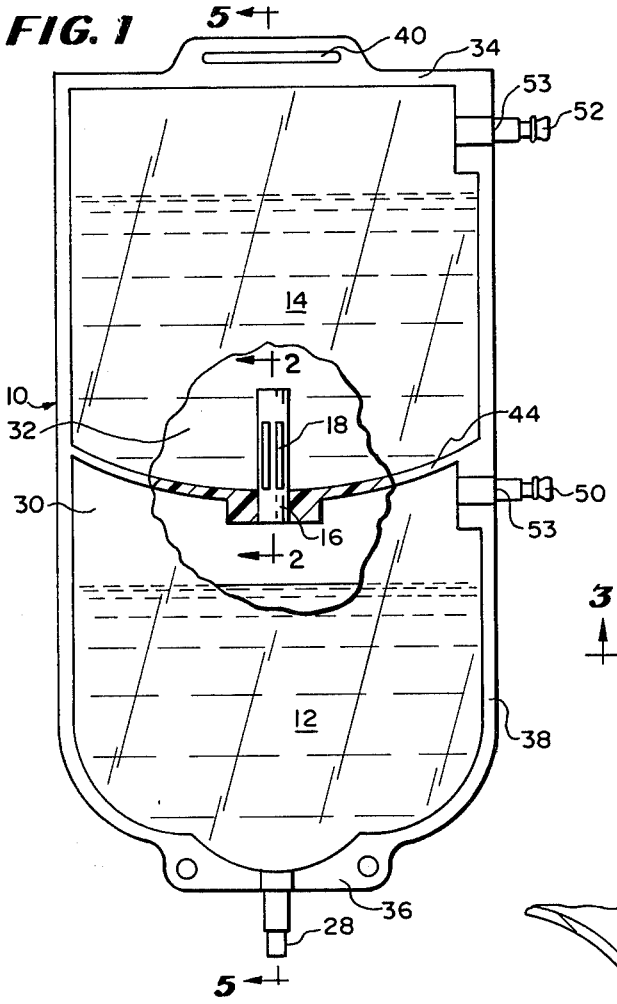
FIG. 1 is a front elevational view of a collapsible, medical fluid container having multiple chambers for containing separate quantities of medical fluid and embodying the present invention.
Figure 2:
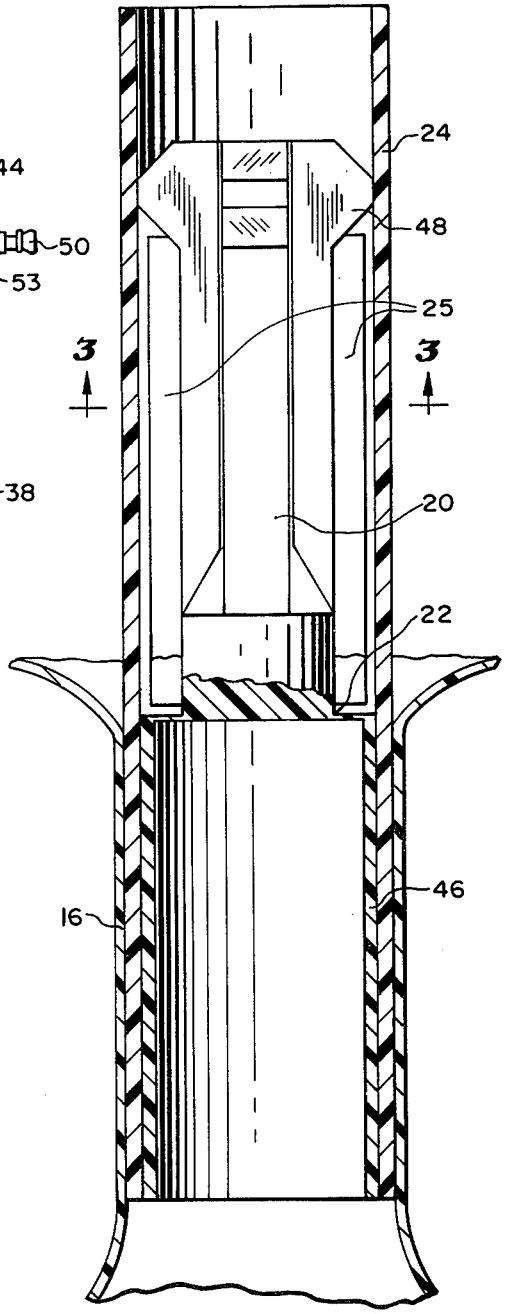
FIG. 2 is an enlarged vertical cross-sectional view of a frangible closure which normally closes the opening between adjacent chambers in the container of FIG. 1 taken along line 2—2.
Figure 3:
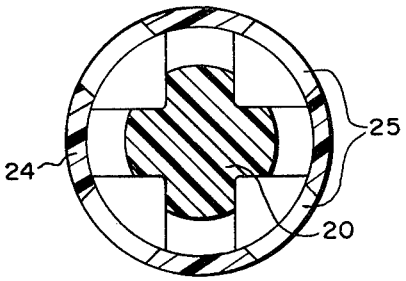
FIG. 3 is a horizontal cross-sectional view of the frangible closure of FIG. 2 taken along line 3—3.

In brief summary of the present invention, and referring to FIGS. 1 and 2, this invention is embodied in a collapsible medical fluid container 10 with two or more sealed compartments or chambers 12 and 14 for containing separate quantities of medical fluid. A connecting port 16 communicating between the chambers is normally sealed by frangible closure 18 which may be opened by manipulation from outside the container 10 so as not to impair sterility of the contents. Preferably, closure 18 has an elongated relatively rigid portion 20 and a thin wall weakened portion 22. In accordance with the present invention, the elongated portion 20 is enclosed in a flexible tube 24 which may be grasped through the flexible container walls, and flexed until the thin wall portion 22 of the closure 18 breaks, opening the port 16 for flow of the contents therethrough. Preferably the elongated portion 20 is captured within the tube 24 by frictional contact with the inside surface of the tube or by retention means such as constricted end portion 26, as shown in FIG. 8. The star-shaped cross-sectional shape of the elongated portion 20, as shown in FIG. 3, permits flow through the tube 24 while the elongated portion 20 is captured therewithin.

Longitudinal slits 25 in the tube 24, as shown in FIG. 4, also greatly facilitate the flow of fluids through the port 16 between the chambers 12, 14 during mixing. In the alternative, as shown in FIG. 7, a flexible connector 27 may be attached on either side of the frangible portion 22 to retain the rigid portion after the closure is opened. This embodiment is used without an enclosing tube 24.

In those applications where the contents of the chambers, e.g., dextrose and amino acid are intermixed, this is accomplished in a convenient and in a completely sterile environment. The combined, sterile contents may then be dispensed to the patient or as otherwise required, through outlet port 28 in the end of the container. When enclosed within tube 24, there is no risk of the elongated portion 20 puncturing the container, and the tube 24 or the flexible connector 27 prevents the broken off portion from floating around freely in the fluid.

Alternatively, in a periodic dosage application, fluid in the lower chamber 12 may be dispensed first and the frangible closure 18 broken only when a further dosage is prescribed.

In another embodiment, as shown in FIG. 11, a dry drug or other reagent may be placed in chamber 12, while an appropriate diluent or other liquid reagent is placed in chamber 14. The frangible closure 18 is opened as specified above, and the contents of the chambers 12, 14 are reconstituted or intermixed in a sterile environment. The drug or reagent may also be encapsulated for easier handling or manufacture and placed in the upper chamber 12.

DETAILED DESCRIPTION OF THE INVENTION

Turning now to a more detailed description of the attached drawings, FIGS. 1 and 5 depicts one embodiment of the present invention. The container 10 has front and back walls 30 and 32 of plastic sheet or web material, heat sealed together along the top, bottom, and side marginal edges 34, 36 and 38. The top marginal edge 34 is slightly lengthened and slotted at 40 to provide a hang flap for suspending the container during administration of fluid through the outlet port 28 which extends through the lower marginal edge 36 of the container. The outlet port 28 is typical of the construction used for collapsible parenteral solution containers and has an inner diaphragm or membrane seal 42 which is opened by puncturing from the inlet spike of an administration set.

The front and back walls 30 and 32 are heat sealed together along a transverse, concave seal line 44 which extends between the side edges 38 of the container 10 and divides the container 10 into separate upper and lower chambers 14 and 12 of selected size for containing different incompatible or reactive ingredients, such as dextrose and heparin or dextrose and amino acid, or separate quantities of the same solution. The seal 44 is continuous except for a center connecting aperture or port 16 which, when open, permits flow between the two chambers 12, 14. The slight concave curvature of the seal line 44 not only provides greater seal strength, but helps to direct fluid into the center port 16 when the container 10 is in the hanging position. Although only one aperture or port 16 is shown, additional ports could be added if additional flow between the chambers is needed.

As noted earlier, the port 16 is normally hermetically sealed or closed against flow between the chambers 12 and 14 by the frangible closure 18. Referencing to the enlarged FIG. 2, the frangible closure 18, in the embodiment shown, is mounted within the flexible plastic tube 24 which is sealed within the connecting port 16. The frangible closure 18 itself is of generally one-piece molded plastic construction with a hollow tubular portion 46 closed at one end by the elongated relatively rigid portion 20. Although it may be made of any suitable, medically inert plastic, vinyl, polyethylene or polypropylene are typical materials which may be used. The elongated portion 20 is attached to the tubular portion 46 by the relatively thin wall portion 22 which is sufficiently weak that it will fracture upon repeated flexing of the elongated portion 20. The surrounding flexible tube 24 shields the container walls from the elongated portion 20 of the closure 18 and helps prevent accidental puncture when the frangible closure 18 is grasped through the container walls 30, 32.

Tube 24 also serves to prevent the elongated portion 20 of the frangible closure 18 from floating freely within the solution after it has been opened. The tube 24 is of sufficiently smaller diameter than the extended vanes 48 of the elongated portion 20 frictionally retain elongated portion 20 within tube 24. Alternatively, the end of the tube 24 may be slightly constricted or narrowed as at 26 in FIG. 8, to retain the elongated portion 20 therewithin. Because of the general star-shaped cross-section (FIG. 3) of the elongated portion 20 there remains sufficient space between the elongated portion 20 and the inside surface of the tube 24 for fluid passage.

Additionally, longitudinal slits 25 are provided in tube 24 to greatly facilitate the flow of fluid through the port 16 and between the chambers 12, 14. As shown in FIG. 6, after the frangible closure 18 is broken, fluid mixing is easily achieved by alternately compressing each chamber, forcing fluid back and forth therebetween for thorough mixing in a completely sterile environment.

For filling the chambers 12 and 14, lateral fill ports 50 and 52 are provided through the side edge of the container. Although the fill ports 50, 52 could be located elsewhere on the container 10, they are preferably all located along the same edge so that production and filling may be achieved without the need to turn container 10, which often requires special handling and tends to slow production speeds. For fluids of different volumes, it is preferred that the smaller volume fluid be filled in the top chamber 14, and the larger volume filled in the lower chamber 12, which may be sufficiently large to hold the total fluid quantity after intermixing. More importantly, as a safety precaution, it is also preferred that the most benign fluid be in the lower chamber 12 so that in the event of inadequate mixing, it is the first fluid administered to the patient. For the fluids discussed in the introduction, heparin or amino acid would preferably be in the upper chamber 14 and dextrose in the lower chamber 12. After the filling operation is complete, the ports 50 and 52 are preferably sealed with a piercable diaghragm 53 so that the post later may be used for addition of any further drugs or medicaments which may be prescribed.

FIG. 7 shows an alternative version of the frangible closure 20 employed in each of the containers of the present invention. In this embodiment, the frangible closure 20 has a flexible connector strap 27, one end of which is attached to the elongated, break-off portion 20 and the other end to the hollow tubular portion 46 of the frangible closure 20, which as described earlier, is sealed within the connector port 16 between adjacent chambers. The strap 27 is sufficiently flexible to permit the bending action needed to fracture the thin wall portion 22 of the closure 20, but because the ends are attached on either side of the thin wall frangible portion 22, it retains the elongated portion 20 after the closure 26 has been opened, to prevent it from floating freely in the chamber.

FIG. 9 depicts a collapsible medical fluid container 54 in accordance with the present invention, which is of similar construction to that illustrated in FIG. 1, but has several transverse seal lines 56 so as to define many chambers 58 of approximately the same size in series arrangement between the top and bottom of the container 54. This embodiment is particularly applicable to the situation where a selected quantity (unit dose) of medicament is to be periodically administered to the patient. Once the container 54 is attached to the patient, via an administration set, additional dosages may be administered simply by breaking the frangible closure 60 on the lowest unused chamber. The liquid would flow downwardly, through any previously emptied chambers, to the patient. No further procedures or time consuming administrative routines are required of the physician or nurse. To illustrate that the particular direction of the elongated portion of the frangible closure 60 is not critical to the operation of the present invention, this embodiment illustrates the frangible closures 60 pointed upwardly into the upstream chamber.

FIG. 10 shows another alternative container 62, similar to the container 10 of FIG. 1, but with the space above transverse seal line 64 being divided by vertical seal lines 66, which extend between the transverse seal line 64 and the upper marginal seal 68 of the container, and forming a series of sub-chambers 80 in parallel flow relationship to one another. Each sub-chamber has a connecting port 82, normally closed by frangible closure 84 as discussed above, for communicating with lower chamber 86 which empties through dispensing port 88.

Finally, as illustrated in FIG. 11, dry drugs or other reagents 90 may be sealed in the upper chamber 14. The lower chamber 12 contains a diluent 92, such as sterile water for reconstituting the dry material 90 or another selected liquid reagent. Maintaining the dry and liquid agents separately permits them to be appropriately mixed in a completely sterile environment by opening of frangible closure 18 and mixing the contents of chambers 12, 14 as shown in FIG. 6. Handling, convenience of supply, and regulated dosage are also facilitated by this usage. In addition, FIG. 12 shows a drug or agent encapsulated in capsule 94 which may be mixed or reconstituted as discussed above.

It is to be understood that the term "medical agent" includes any dry or liquid ingredient, medically or chemically active, or inactive agents such as water or other diluents, or other components that can be used with the invention discussed herein.

In summary, with any of the containers of the present invention, multiple quantities of one or more medical fluids or dry drugs or other reagents may be stored in separate, hermetically sealed compartments or chambers within the same container until they are needed for administration to the patient. For those medical agents which are reactive or incompatible, storage in separate sealed chambers provides a long shelf life, yet mixing of the agents when needed is achieved quickly and easily, and in a totally sterile environment, as no penetration of the container wall is needed to open the frangible closure separating the chambers. For periodic administration of quantities of the same agents, the present invention provides a simple and effective solution to the additional procedures and routines often required of medical personnel when such treatment is prescribed.

Although the present application has been described in terms of the illustrated embodiments, it is intended that the scope of this invention, as set forth in the attached claims, includes those equivalent structures apparent to one skilled in the art upon reading this description.

We claim:

1. A container for storing medical agents and the like in separate chambers, said container comprising:

flexible plastic walls selectively sealed to define a plurality of adjacent chambers;

a connecting port communicating between a pair of said chambers;

opening means in one of said chambers for permitting agent flow from said chamber and out of said container;

frangible closure means preventing agent flow through said connecting port to maintain said adjacent chambers in separate sealed condition, said frangible closure means being manually openable from the exterior of said container to permit agent flow between said adjacent chambers; and retention means sealed within said connecting port, frictionally restraining said frangible closure means and preventing said frangible closure means from migrating within said adjacent chambers after the opening of said frangible closure means.

2. A container in accordance with claim 1 wherein said frangible closure means comprises an elongated relatively rigid portion extending into a selected one of said adjacent chambers and a weakened portion adjacent said first opening means, whereby bending of said elongated portion results in fracturing said weakened portion to permit agent flow between said adjacent chambers.

3. A container in accordance with claim 1 or 2 wherein said retention means comprises a flexible tube disposed around said frangible closure means.

4. A container in accordance with claim 3 wherein said tube has longitudinally arrayed openings along its length to facilitate agent flow between said chambers upon opening said frangible closure means.

5. A container for storing medical agents and the like in separate chambers, said container comprising:

flexible plastic walls selectively sealed to define a plurality of adjacent chambers;

a connecting port communicating between a pair of said chambers;

opening means in one of said chambers for permitting agent flow from said chamber and out of said container;

frangible closure means preventing agent flow through said connecting port to maintain said adjacent chambers in separate sealed condition, said frangible closure means being manually openable from the exterior of said container to permit agent flow between said adjacent chambers; and retention means sealed within said connecting port, preventing said frangible closure means from migrating within said adjacent chambers after the opening of said frangible closure means.

6. A container for storing medical agents and the like in separate chambers, said container comprising:

flexible plastic walls selectively sealed to define a plurality of adjacent chambers;

a connecting port communicating between a pair of said chambers;

opening means in one of said chambers for permitting agent flow from said chamber and out of said container;

frangible closure means preventing agent flow through said connecting port to maintain said adjacent chambers in separate sealed condition, said frangible closure means being manually openable from the exterior of said container to permit agent flow between said adjacent chambers; and retention means including a flexible tube disposed around said frangible closure means, said flexible tube sealed within said connecting port and including an end of reduced diameter which restrains said frangible closure means within said flexible tube, thereby preventing said frangible closure means from migrating within said adjacent chambers after the opening of said frangible closure means.

* * * * *